US005908680A

United States Patent [19]

Moren et al.

[11] Patent Number: 5,908,680

[45] Date of Patent: Jun. 1, 1999

[54] REPLACEABLE ROLL COVERS WITH REPOSITIONABLE PRESSURE SENSITIVE ADHESIVE

[75] Inventors: Louis S. Moren; David E. Johnson; Dennis G. Welygan, all of St. Paul, Minn.

[73] Assignee: Minnesota Mining and Manufacturing Company, St. Paul, Minn.

[21] Appl. No.: 08/611,038

[22] Filed: Mar. 5, 1996

[51] Int. Cl.[6] ..... B32B 7/12

[52] U.S. Cl. ..... 428/40.1; 19/112; 19/128; 428/42.1; 428/42.2; 428/42.3; 428/119; 428/120; 428/354; 428/355; 428/906; 492/52; 492/56

[58] Field of Search ..... 428/40.1, 42.1, 428/42.2, 42.3, 119, 120, 354, 355, 906; 19/112, 128; 492/52, 56

[56] References Cited

U.S. PATENT DOCUMENTS

| | | | |
|---|---|---|---|
| 176,171 | 4/1876 | Dow | 139/296 |
| 192,897 | 7/1877 | Burns | 139/296 |
| 214,447 | 4/1879 | Prouty et al. | 139/296 |
| 226,548 | 4/1880 | Prouty et al. | 139/296 |
| 239,467 | 3/1881 | Draper | 139/296 |
| 405,387 | 6/1889 | Allen | 139/296 |
| 426,969 | 4/1890 | Stiner et al. | 26/51 |
| 543,789 | 7/1895 | Simpson | 139/296 |
| 679,608 | 7/1901 | Duffy | 139/296 |
| 1,621,177 | 3/1927 | Simpson | 139/296 |
| 1,730,357 | 10/1929 | Carpenter | 492/44 |
| 2,038,782 | 4/1936 | Ellis | 51/297 |
| 2,088,378 | 7/1937 | Krehbiel | 139/304 |
| 3,308,522 | 3/1967 | Miller | 29/120 |
| 3,514,829 | 6/1970 | Blatt | 29/130 |
| 3,568,596 | 3/1971 | Mashburn | 29/120 |
| 3,691,140 | 9/1972 | Silver | 260/78.5 |
| 3,812,561 | 5/1974 | Lundgren | 29/121 A |

(List continued on next page.)

FOREIGN PATENT DOCUMENTS

| | | |
|---|---|---|
| 0 476 992 B1 | 3/1990 | European Pat. Off. . |
| 0 683 125 A2 | 5/1995 | European Pat. Off. . |
| 33 02 843 A1 | 8/1984 | Germany . |
| 36 22 792 A1 | 2/1988 | Germany . |
| 2 223 452 | 8/1988 | United Kingdom . |
| 2 260 182 | 4/1991 | United Kingdom . |
| WO 93/1889 | 9/1993 | WIPO . |
| WO 94/29070 | 12/1994 | WIPO . |
| WO 95/19242 | 7/1995 | WIPO . |

OTHER PUBLICATIONS

International Search Report for PCT/US97/01704.

*Research Product Technical Bulletin,* Shell Polypropylene Company, "Shell Polypropylene SRD7–560": 1 pp.

*Material Safety Data Sheet,* Shell Polypropylene Company, "Polypropylene—Copolymer Research Grade," MSDS No. 3.777–1 N, 4 pp., Apr. 8, 1992.

"Brushlon® Products Belts, wheels, discs, rolls & cylinder brushes," Minnesota Mining and Manufacturing Company, St. Paul, MN 55144–1000, Form 60–4400–0387–3(653)K.

"Scotch™ Laminating Adhesive for Scotch™ Brand 9851 and 9852 Laminating Adhesive," Data Page, Minnesota Mining and Manufacturing Company, St. Paul, MN 55144–1000, 4 pp., 1995.

(List continued on next page.)

*Primary Examiner*—Nasser Ahmad
*Attorney, Agent, or Firm*—James J. Trussell

[57] ABSTRACT

A textile pull roll cover is disclosed which has an exterior side with desired frictional characteristics for engagement with an advancing textile web. On its opposite side, the pull roll cover is affixed to a cylindrical outer surface of a textile pull roll by a repositionable pressure sensitive adhesive disposed therebetween. A method for making a textile pull roll is disclosed, as well as a method for changing a pull roll cover using repositionable pressure sensitive adhesive.

19 Claims, 3 Drawing Sheets

U.S. PATENT DOCUMENTS

| | | | |
|---|---|---|---|
| 4,166,152 | 8/1979 | Baker et al. | 428/522 |
| 4,455,954 | 6/1984 | Franck, III et al. | 112/262.3 |
| 4,545,544 | 10/1985 | Rockerath et al. | 242/55 |
| 4,609,581 | 9/1986 | Ott | 428/100 |
| 4,627,127 | 12/1986 | Dupre | 15/179 |
| 4,959,265 | 9/1990 | Wood et al. | 428/343 |
| 5,077,870 | 1/1992 | Melbye et al. | 24/452 |
| 5,201,101 | 4/1993 | Rouser | 24/575 |
| 5,230,124 | 7/1993 | Booth | 19/112 |
| 5,325,569 | 7/1994 | Goulait et al. | 24/448 |
| 5,435,816 | 7/1995 | Spurgeon et al. | 51/295 |
| 5,548,861 | 8/1996 | Hubuka | 428/906 |

OTHER PUBLICATIONS

"ScotchMark® Brand Identification Systems, Scotch™ Brand 919 Laminating Adhesive Tape," Product Information, Minnesota Mining and Manufacturing Company, St. Paul, Minnesota, 2 pp, 3M SP–VPI–919 (22.5)R1.

"Scotch™ Laminating Adhesive," Data Page, Minnesota Mining and Manufacturing Company, St. Paul, Minnesota, 4 pp., 70–0704–8324–6(34.1)R1, Feb. 23, 1994.

"Laminating Adhesive" Data Page, Minnesota Mining and Manufacturing Company, St. Paul, Minnesota, 4 pp., 70–0706–0438–7(65.3)R1, Jun. 5, 1995.

"Mechanical Fasteners," Product Information, Minnesota Mining and Manufactring Company, St. Paul, Minnesota, 2 pp., MECHCLOS Aug. 1995 DRC, 1995.

Guilford, Style #18904, *Material Specification Sheet,* dated Dec. 10, 1993, 1 pp.

illbruck, inc., *Technical Data Sheet,* A210 with 14 pt. release liner, illbruch item #17229, 1 pp.

REPLACEABLE ROLL COVERS WITH REPOSITIONABLE PRESSURE SENSITIVE ADHESIVE

BACKGROUND OF THE INVENTION

The present invention relates to apparatus for selective engagement with an advancing web. In particular, the invention relates most specifically to apparatus and methods for the assembly and ready replacement of covers for rolls used to engage advancing webs.

It is well known to provide a cylindrical roll with specifically desired frictional characteristics on its exterior surface for use in web advancement and treatment processes. In the textile industry, the use of rolls to convey, pull and hold back fabric is very common, and these rolls are referred to as pull rolls. For instance, weaving machines, inspection machines, finishing lines, napping lines, sueding lines and dye lines all contain numerous pull rolls to aid in performing such operations. Steel or aluminum rolls themselves do not provide surfaces with sufficient frictional forces to keep fabric from slipping in most applications. Such rolls are thus covered or coated with a material which aids in gently guiding the fabric through the textile processing machinery without distorting its weave, yet keeping the fabric relatively uniform in advancement and spread.

The cover on a pull roll may have a low or high coefficient of friction, depending upon the particular fabric, process characteristics and desired engagement or traverse of the pull roll with the fabric. Numerous materials have been used to define the frictional interaction between the roll surface and the fabric. Typical prior art pull roll cover materials include cork, rubber, modified cork, smooth rubber, sandpaper and bristle-bearing materials. During use of such materials, their frictional characteristics can change. For instance, cork and rubber-based materials tend to glaze over as they wear and become smoother, presenting a change in friction level to the fabric web over time. This can result in a slow deterioration of fabric quality or increased motor power usage due to slipping, which are both difficult to detect. In addition, abrasives such as sandpaper do not wear evenly, because of their random surface textures. Further, while abrasives such as sandpaper present higher frictional characteristics for a pull roll cover, they are non-uniform by design and thus are unsuitable for some fabric webs because their non-uniformity results in damage to the fabric. Pull roll covers based on a bristled structure (such as the BRUSHLON® brush material of Minnesota Mining and Manufacturing Company, St. Paul, Minn.), are also random in bristle dispersion and alignment.

A pull roll cover material is typically applied by helically wrapping a two to three inch wide strip of the material down the length of the roll. Adhesion of the material to the roll surface has been accomplished by the use of contact cements, spray adhesives, and nonrepositionable pressure sensitive adhesives. To remove such roll covers from a roll requires removal of the roll from the textile processing machinery, and in some instances the machining off of the covering. These types of adhesion arrangements typically lead to buildups of adhesive on the roll surface over time, contain flammable solvents in the adhesive, require long cure times on the roll surface, and in many cases require the use of flammable solvents for roll clean-up. Environmental concerns and restrictions now prohibit the use of many of these adhesives in textile plants, thereby requiring the removal and application of roll surfaces by outside parties and at locations other than the textile processing facility.

One type of pull roll cover forms a cylindrical brush, as disclosed in Dupre U.S. Pat. No. 4,627,127. In Dupre, a fabric strip containing bristles on an outer peripheral surface thereof is wrapped in a helix about a cylinder. The fabric strip is adhered to the cylinder by means of an adhesive such as polyurethane. Through use, the bristles wear down and the remaining covering must be replaced. To remove such a covering bonded to the cylinder by an adhesive requires the use of solvents. This can be messy, relatively time consuming (resulting in machine downtime) and, as mentioned above, the use of solvents to remove adhesives creates undesirable hazardous waste removal issues.

In an effort to address these environmental concerns, and also to form a more readily replaceable pull roll cover, mechanical fastening schemes (such as hook-and-loop fastener structures) have been used instead of adhesives to bond the cover material to the roll. One roll cover material currently available for this purpose has ⅛" trim nylon 6.12 bristle BRUSHLON® brush material (available from Minnesota Mining and Manufacturing Company, St. Paul, Minn.) on one side of a support substrate, with a loop structure material on its other side. A hook structure material (having projecting hooks or capped stems thereon) is bonded to the exterior surface of the cylindrical roll, typically in strip form wrapped thereabout in a helix. The bristle/loop structure assembly is also wrapped in strip form in a helix about the cylindrical roll, with the loop structure interengaging with the hook structure to affix the bristle/loop structure assembly to the pull roll cylinder. While this arrangement allows for ready removal of the exterior bristle bearing fabric, and replacement thereof with an alternative roll exterior material having a loop structure backing, it also is not ideal. The combination of the bristles, support substrate and hook-and-loop fastener form a pull roll cover assembly having a relatively high profile. Further, if the pull roll cover material is wrapped in an imperfect helix along the roll, one or more hooks may be inadvertently exposed from the hook structure material mounted on the cylindrical roll. These exposed hooks can damage the fabric web being traversed by the roll by picking or tearing at fabric fibers, creasing the fabric, scuffing its surface or by causing some other similar surface phenomenon.

A typical textile pull roll will have a diameter in the range of 4–12 inches, but can be smaller or larger. A high profile (relatively thick) pull roll cover increases the effective diameter of a pull roll, and this effect is even more significant on a smaller diameter pull roll (e.g., a 1–3 inch diameter pull roll). It is an undesirable necessity that drive roll speeds be adjusted if a significant change in roll diameter results from the application of a roll cover, and thus a pull roll cover should be as thin as possible.

The pickup or transfer of particulates or fluids by a pull roll cover is also undesirable. A cover material is also unacceptable if it allows lint and fiber build-up thereon during use. In addition, in some applications the roll or fabric web will be wet. For example, a roll cover must not pick up and hold fabric dyes from the manufacturing process. Color changes are common and the transfer of dyes from one fabric lot to another is unacceptable.

In view of the disadvantages associated with the various pull roll cover schemes of the prior art, it is desirable to provide a pull roll that has a changeable exterior covering, wherein the covering is relatively inexpensive, reusable or replaceable, easily and securely attachable to the cylindrical pull roll and which, in use, does not allow undesirable contact or damage to the web traversed thereby. A pull roll cover and its attachment means should also have as low a profile as possible, and the covers should be resistive to collecting lint or fibers, and resistive to the transfer of dyes between webs. In addition, an exterior material for a pull roll cover is desired that has a long life, and provides the desired frictional characteristics, or range of frictional characteristics for customer flexibility.

SUMMARY OF THE INVENTION

The present invention includes a low profile engagement apparatus for use on a roll having a cylindrical outer surface. The engagement apparatus comprises a surface substrate sheet having first and second sides, with the second side thereof having desired characteristics for frictional engagement with an advancing web. A repositionable pressure sensitive adhesive is disposed between the cylindrical outer surface of the roll and the first side of the surface substrate sheet to releasably adhere the surface substrate sheet to the cylindrical outer surface of the roll for replacement or realignment.

In one embodiment, the second side includes means for defining a frictional engagement surface for the advancing web. The defining means includes a plurality of surface stems projecting outwardly from the second side of the surface substrate sheet, with the surface stems collectively defining an operative contact surface for contacting the advancing web. Preferably, the surface stems are disposed in a selected arrangement on and formed integrally with the second side of the surface substrate sheet.

The present invention further includes a method of making a roll, which includes providing a base having an outer cylindrical surface and providing a substrate sheet having first and second major sides. The second side of the substrate sheet has the desired characteristics for frictional engagement with an advancing web. The method further includes releasably bonding the first side of the substrate sheet to the outer cylindrical surface of the base with a repositionable pressure sensitive adhesive to permit ready removal or realignment of the substrate sheet relative to the base. Preferably, the inventive method further includes positioning the repositionable pressure sensitive adhesive on the first side of the substrate sheet prior to the bonding thereof to the base.

The apparatus and method of the present invention are particularly suitable for application to textile pull rolls. The invention is further embodied in a method of changing the outer textile engaging surface of a textile pull roll. In this process, a pull roll is provided having a cylindrical pull roll base, with an initial substrate sheet releasably affixed to the pull roll base. The initial substrate sheet has first and second major sides, with the second side of the initial substrate sheet being defined by a textile engagement material and the first side thereof being bonded to the pull roll base by a repositionable pressure sensitive adhesive. The initial substrate sheet and textile engagement material thereon are removed from the pull roll base by overcoming the adherence force of the repositionable pressure sensitive adhesive. A replacement substrate sheet having first and second major sides is provided, with its second side being defined by a replacement textile engagement material. The replacement substrate sheet is affixed to the cylindrical pull roll base by means of a repositionable pressure sensitive adhesive disposed therebetween to permit replacement or realignment thereof on the cylindrical pull roll base.

BRIEF DESCRIPTION OF THE DRAWINGS

The present invention will be further explained with reference to the drawing figures referenced below, wherein like structure is referred to by like numerals throughout the several views.

Figure 1:
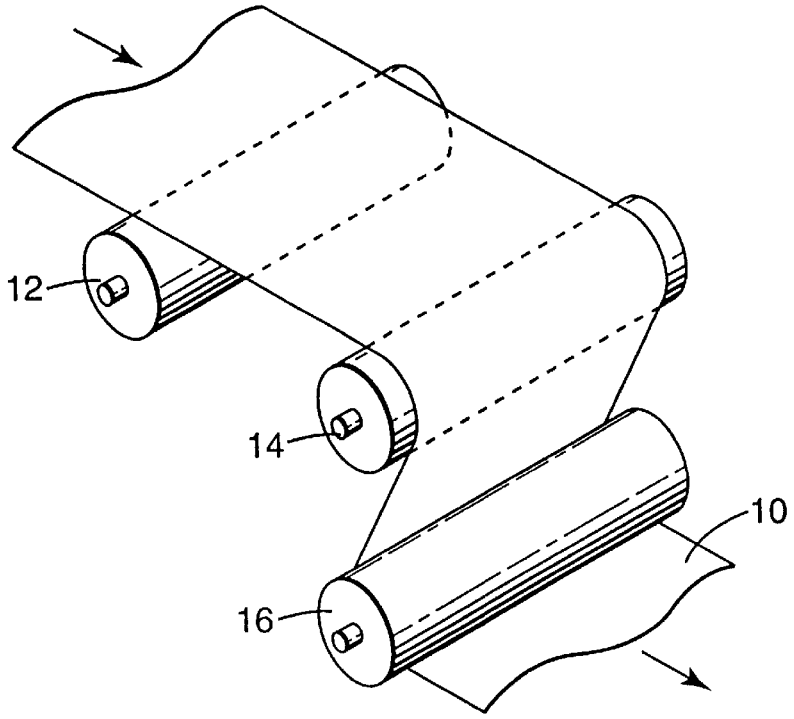
FIG. 1 is an isometric view of a textile web being advanced over a pull roll cover of the present invention.

While the above-identified drawing features set forth several preferred embodiments, other embodiments of the present invention are also contemplated, as noted in the discussion. This disclosure presents illustrative embodiments of the present invention by way of representation and not limitation. Numerous other modifications and embodiments can be devised by those skilled in the art which fall within the scope and spirit of the principles of this invention. The drawing figures have not been drawn to scale as it has been necessary to enlarge certain portions for clarity.

DETAILED DESCRIPTION OF THE PREFERRED EMBODIMENTS

FIG. 1 illustrates a textile or fabric web 10 being processed along a web travel path which is defined, at least in part, by textile pull rolls such as pull rolls 12, 14 and 16. Such rolls may be driven or idler rollers, depending upon the processing application. The surfaces of the rolls are coated or covered with materials having the desired frictional characteristics for the application and for the fabric web being processed. The pull rolls are intended to keep the fabric web taut and uniformly disposed as it is processed. Depending upon the requirements for a specific pull roll, a high degree of friction may be required between the pull roll and fabric web to prevent slippage, or a low degree of friction may be required to allow a controlled degree of slippage of the fabric web over the pull roll.

Figure 2A:
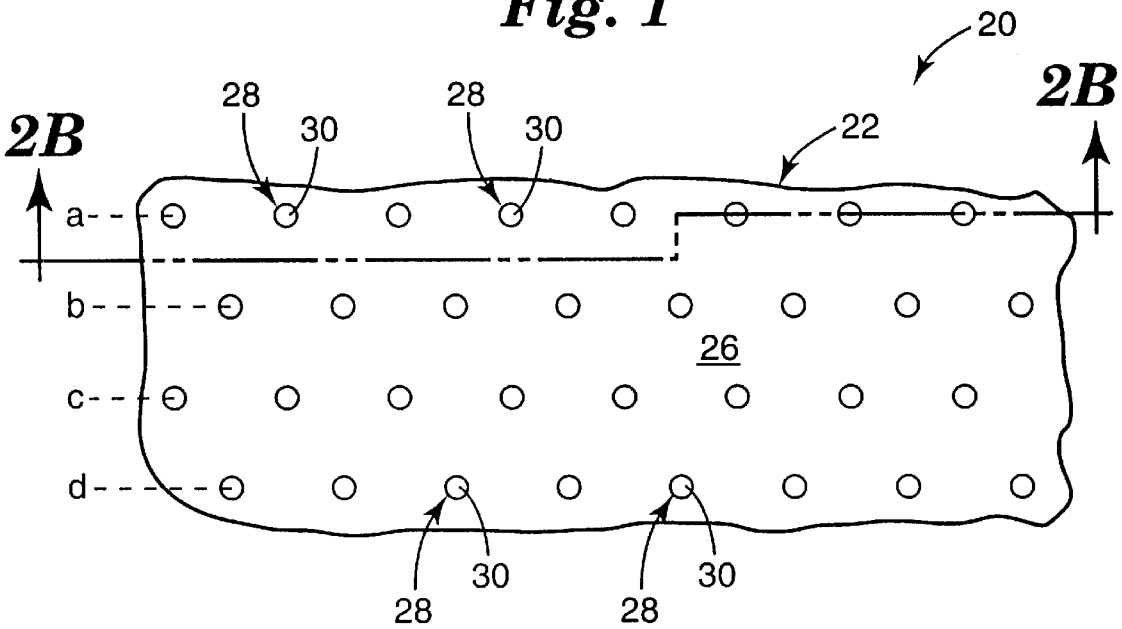
FIG. 2A is a top plan view of the exterior pull roll cover of the present invention having upwardly projecting surface stems.
Figure 2B:
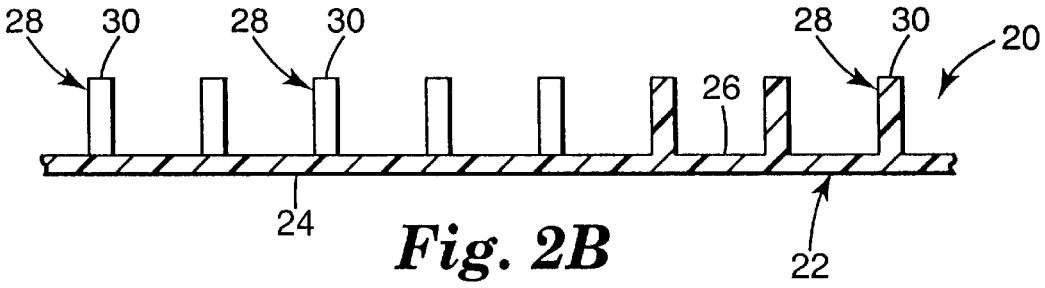
FIG. 2B is a sectional view as taken along lines 2B—2B in FIG. 2A.

FIGS. 2A and 2B illustrate the inventive pull roll cover material of the present invention. Functionally, the inventive pull roll cover 20 has a substrate 22 with a first side 24 adapted to be mounted onto a pull roll, and a second side 26 defining a frictional engagement surface for a fabric web which may be traversed or advanced over the pull roll. This engagement surface is further defined by a plurality of surface stems 28, which are disposed in a selected arrangement (it is preferred that this arrangement be a predetermined pattern) across the second surface 26, and are formed to have a generally uniform height projection from the substrate sheet 22. The selected arrangement for surface stem dispersal is preferably a uniform array, although any arrangement of surface stems is possible (including even a randomly designed dispersal of surface stems within a given area). In a preferred embodiment, the surface stems 28 are arrayed in staggered rows across the substrate 22, such as row a, b, c, d in FIG. 2. Preferably, each surface stem 28 projects at a right angle relative to the second side 26 of the substrate 22, but alternatively angled stem orientations are also contemplated.

Preferably, the surface stems 28 and substrate 22 are formed integrally as a stem web, and the substrate requires no additional support layer or backing material. As shown, the surface stems 28 of the preferred embodiment are equally spaced apart and each is round in lateral cross section, having a generally uniform diameter along its height, from its outer end 30 to the second side 26. The surface stems 28 collectively serve to define an operative region or contact surface for the pull roll cover which contacts the advancing fabric web.

With a pull roll cover material 20 of this design (e.g., FIGS. 2A and 2B), the surface stems 28 provide a very uniform frictional engaging surface for presentation to the advancing fabric web, both initially, and as the surface stems 28 wear down during usage. The surface stems 28 wear uniformly, and since the diameter of the surface stems 28 is generally uniform along their height in the preferred embodiment, the surface area of stem ends 30 does not change because of changing stem structure along the entire height of the surface stems 28 as the surface stems 28 wear down. The inventive pull roll cover material thus presents a frictional engaging surface that is resistant to glazing and maintains a constant friction level during its useful life.

The use of uniformly disposed and formed surface stems as the engaging surface of a pull roll cover results in a highly controllable and predictable frictional engagement relationship between the pull roll cover and web. In addition to opposed roll and web material-to-material frictional interengagement characteristics, the precisely formed nature of the pull roll cover surface introduces a significant mechanical engagement component into the frictional engagement relationship. The upstanding surface stems on the pull roll cover penetrate interstices on the web surface (e.g., between the crossed fibers of its weave for a woven web) to engage the web mechanically. Testing demonstrates that such surface stems disposed on a pull roll cover do not damage many woven fabrics, as otherwise might be expected. Outer end portions of the surface stems actually engage the threads of a woven fabric web to mechanically engage with the woven web as it is advanced past the pull roll. While such mechanical interengagement is a factor in the frictional relationship of prior art pull roll cover materials and woven webs (e.g.,bristle based covers or abrasive material covers), those cover materials are not entirely uniform in the dispersement of their bristles or abrasive particles (as well as being less than fully uniform in terms of the size, height and diameter of their bristles or particles). As a result, the web engagement surfaces presented by those prior art cover materials to the web were not as uniform frictionally as desired. The uniformly shaped, sized and disposed surface stems of the present inventive pull roll cover present a homogeneous frictional surface for contacting the web. The surface stems of the inventive pull roll cover are particularly useful and effective in this regard when the web has a relatively uniform surface structure (e.g., woven or knitted), although the mechanical engagement characteristics are evident in relation to other web structures as well (e.g., spun bonded, nonwoven, etc.).

The inventive pull roll cover 20 illustrated in FIGS. 2A and 2B is resistant to the pickup of lint and fiber during use. Further, it is possible to use materials to fabricate the inventive pull roll cover 20 so that the cover 20 is resistant to dye pickup and transfer from the fabric web. In one embodiment, the inventive pull roll cover 20 is molded from SRD7-560 impact copolymer resin available from Shell Polypropylene Company, Houston, Tex. Other possible materials for forming the pull roll cover 20 include Prevail™ 3050, available from Dow Chemical Company, Midland, Mich., Himont KS084P, available from Montell-Himont, Atlanta, Ga., and Hytrel™ 5526 or Surlyn™ 1702, both available from E. I. duPont de Nemours & Co., Inc., Wilmington, Del.

The nature of the inventive cover 20 is described by its combination of stem height, stem diameter, stem spacing and number of stems per square inch. The frictional characteristics of the cover 20 presented to the fabric web are altered by changing stem density, stem diameter, stem height or stem spacing, which in turn affect the surface area presented by the stem ends 30 of the surface stems 28 to the fabric web, and also affect the mechanical engagement relationship between the weave of the fabric web and the surface stems 28 (e.g., a change in stem height may affect stem flexibility). Four examples of these parameters for the cover 20 are listed in Table I below:

TABLE I

| Item | Stem Density | Substrate Thickness | Stem Height | Stem Diameter | Stem Spacing |
|---|---|---|---|---|---|
| A1 | 325 stems/in$^2$ | 0.005" | Approx. 0.037" | 0.016" | 0.055" |
| A2 | 325 stems/in$^2$ | 0.005" | Approx. 0.025" | 0.015" | 0.055" |
| A3 | 960 stems/in$^2$ | 0.004" | Approx. 0.006" | 0.005" to 0.007" | 0.032" |
| A4 | 2300 stems/in$^2$ | 0.003" | Approx. 0.006" | 0.005" to 0.007" | 0.021" |

The stem spacing is the distance between centers of two adjacent stems. As shown in FIG. 2A, in a preferred embodiment the stems are uniformly spaced apart in all directions across the second surface 26 of the substrate 22.

The parameters listed in Table I are not meant to be limiting, and numerous variations in those parameters are possible for a particular cover. For instance, the stem density is preferably greater than 81 stems/in$^2$, and more preferably greater than 100 stems/in$^2$. Table I presents specific stem density examples of 325, 960 and 2300 stems/in$^2$, but stem web stem densities greater than 2300 stems/in$^2$ are also possible. Further, the surface stems may have a height gradient across the pull roll (e.g., shorter in center than near its ends) in order to facilitate web handling, the stems may not be round in cross-section, and the stem density and/or stem spacing may vary across the pull roll. In some applications, it may even be desirable that adjacent stems have different heights, or to have stems which change in profile (i.e., cross-section) along their height (e.g., a cylindrical stem having an enlarged, tapered stem base).

In the pull roll cover 20 just described, and the methods of making such pull roll cover materials described below, the cover material is typically formed by molding a flowable material. The flowable material can be any suitable material, such as a polymer, a metal or a ceramic precursor. It is also within the scope of this invention to use two or more different flowable materials to make the surface stems. The flowable material is a foamed or solid polymeric material (such as that described above), such as a thermoplastic material or a thermosetting material. Other suitable materials include thermoplastic polyurethanes, polyvinyl chlorides, polyamides, polyimides, polyolefins (e.g., polyethylene and polypropylene), polyesters (e.g., polyethylene terephthalate), polystyrenes, nylons, acetals, block polymers (e.g., polystyrene materials with elastomeric segments, available from Shell Chemical Company of Houston, Tex., under the designation Kraton™), polycarbonates, thermoplastic elastomers, and copolymers and blends thereof. The flowable material may also contain additives including but not limited to fillers, fibers, antistatic agents, lubricants, wetting agents, foaming agents, surfactants, pigments, dyes, coupling agents, plasticizers, suspending agents and the like.

Figure 3:
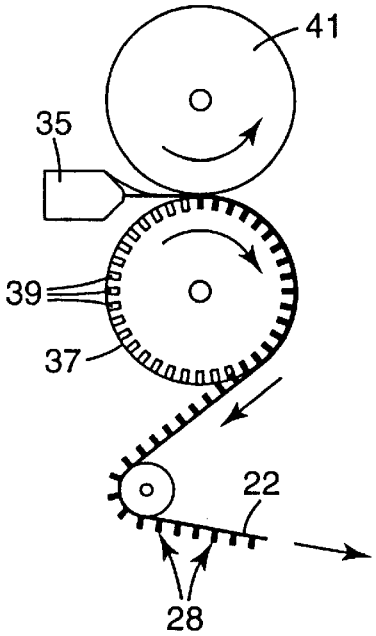
FIG. 3 is a schematic illustration of an apparatus and process for forming the pull roll cover of FIGS. 2A and 2B.

FIG. 3 illustrates one embodiment of an apparatus and process for forming the inventive pull roll cover. This process generally involves molding surface stems in a substrate sheet from which the surface stems project. Substrate sheet 22 is formed, bearing a plurality of projecting surface stems 28 on one major surface thereof. The molding step may include any suitable molding apparatus, as known in the molding art. For example, the surface stems and substrate sheet could be injection molded, molded by compressing a heated sheet member against a molding surface, or molded by molding a flowable material over and into the cavities of a mold, which may be stationary or moving (e.g., a belt, a tape or a drum).

As illustrated schematically in FIG. 3, the process includes an extruder 35 adapted for extruding a flowable material, such as an impact copolymer resin, into a mold 37. The surface of the mold 37 includes a plurality of arranged cavities 39, which are adapted to form a like plurality of surface stems from the flowable material. The cavities 39 may be arranged, sized and shaped as required to form a suitable surface stem structure from the flowable material. Typically, a sufficient additional quantity of flowable material is extruded onto the mold 37 to form substrate sheet 22 concurrently with the formation of surface stems 28. The mold 37 is rotatable and forms a nip, along with an opposed roll 41. The nip between the mold 37 and opposed roll 41 assists in forcing the flowable material into the cavities 39 of the mold 37, and provides a uniform substrate sheet 22. The temperature at which the foregoing process is carried out depends on the particular flowable material used. For example, the temperature is in the range of 140° to 260° C. for an impact copolymer resin available from Shell Polypropylene Company, Houston, Tex., under the designation SRD7-560.

The mold 37 may be of the type used for either continuous processing (such as a tape, a cylindrical drum or a belt), or batch processing (such as an injection mold), although the former is preferred. The cavities 39 of the mold 37 may be formed in any suitable manner, such as by drilling, machining, laser drilling, water jet machining, casting, etching, die punching, diamond turning and the like. The placement of the cavities 39 determines the spacing and orientation of the surface stems 28 on the substrate sheet 22, and thus on the inventive pull roll cover. The mold cavities 39 can be open at the end of the cavity opposite the surface from which the flowable material is applied to facilitate injection of the flowable material into the cavity. If the cavity is closed, a vacuum can be applied to the cavity so that the flowable material fills substantially the entire cavity. Alternatively, closed cavities can be longer than the lengths of the stems being formed so that the injected material can compress the air in the cavities. The mold cavities should be designed to facilitate release of the surface stems therefrom, and thus may include angled side walls, or a release coating (such as a Teflon™ material layer) on the cavity walls. The mold surface may also include a release coating thereon to facilitate release of the substrate sheet from the mold.

The mold can be made from suitable materials that are rigid or flexible. The mold components can be made of metal, steel, ceramic, polymeric materials (including both thermosetting and thermoplastic polymers) or combinations thereof. The materials forming the mold must have sufficient integrity and durability to withstand the thermal energy associated with the particular molten metal or thermoplastic material used to form the substrate sheet and surface stems. In addition, the material forming the mold preferably allows for the cavities to be formed by various methods, is inexpensive, has a long service life, consistently produces material of acceptable quality, and allows for variations in processing parameters.

The flowable material is flowed into the mold cavity, and over the surface of the mold to form the substrate sheet. To facilitate flow of the material, the material typically must be heated to an appropriate temperature, and then coated into the cavities. This coating technique can be any conventional technique, such as calendar coating, cast coating, curtain coating, die coating, extrusion, gravure coating, knife coating, spray coating or the like.

After the thermoplastic material has been coated into the mold cavities and over the mold surface, the material is cooled to solidify and form the surface stems. The flowable material is solidified in and on the mold to form the surface stems and substrate sheet, which are then separated from the mold. The flowable material will often shrink when it is solidified, which facilitates release of the surface stem and substrate sheet from the mold. Part or all of the mold may be cooled to aid in solidifying the surface stems and substrate sheet. Cooling can be effected by the use of water, forced air, liquid nitrogen or other cooling processes.

When thermosetting resins are used as the flowable material, the resin is applied to the mold as a liquid in an uncured or unpolymerized state. After the resin has been coated onto the mold, it is polymerized or cured until the resin is solid. Generally, the polymerization process involves either a setting time, or exposure to an energy source, or both, to facilitate the polymerization. The energy source, if provided, can be heat or radiation energy such as an electron beam, ultraviolet light or visible light. After the resin is solidified, it is removed from the mold. In some instances, it may be desired to further polymerize or cure the thermosetting resin after the surface stem if removed from the mold. Examples of suitable thermosetting resins include melamine, formaldehyde resins, acrylate resins, epoxy resins, urethane resins and the like. The formation of a substrate having upstanding stems on one side thereof is further detailed in pending U.S. patent application Ser. Nos. 08/181,142; 08/181,193; and 08/181,195, all filed Jan. 13, 1994, and which are incorporated by reference herein.

The frictional characteristics of the inventive pull roll cover 20 have been established through both static and dynamic testing procedures. The dynamic friction was measured between a cloth and a selected pull roll cover surface by the following procedure. A pull roll cover was formed by helically wrapping a two-inch wide strip of the designated cover material on a five-inch diameter roll or core, providing a minimum of a four-inch wide covered surface for evaluation purposes. The five-inch core, end flanges and a one-inch shaft were mounted on a free wheeling supporting shaft. A two-inch wide strip of untreated jeans cloth (specifically, 96×64 jeans cloth, 1.943 yds/lb, Tencel™ fibers, available from Milliken Company, Spartanburg, S.C.) was anchored at one end and placed over the designated pull roll cover material with approximately 180 degrees of wrap. A spring scale and wire were used to rotate the core and measure the amount of force (in ounces) necessary to move the pull roll cover material against the fixed cloth. The spring scale was a Chatillon scale, gauge R, Catalog No. 719-5 (0–5 lb. force gauge) (available from Chatillon, N.Y.).

The results are tabulated in Table II below, and demonstrate the range of friction values provided by the various pull roll cover test materials. The values are in ounces of force required to produce smooth travel between the designated pull roll cover material and the two-inch wide strip of cloth.

TABLE II

| Item | Pull Roll Cover Test Material | Measured Load (ounces) |
|---|---|---|
| B1 | Scotch ™ PTFE (Teflon ™) Film Tape 5491 Extruded[1] | 0 |
| B2 | Smooth Back of Stem Web (Stem Height approx. 0.030", Stem Dia. 0.015", Stem Spacing 0.050", Stem Density 325 stems/in$^2$, Substrate Thickness 0.005")[2] | 0 |
| B3 | Safety-Walk ™ Type 220 Fine Resilient Treads[1] | 1 |
| B4 | Stem Side of Stem Web (same parameters as Item A2 from Table I)[3] | 10 |
| B5 | Guilford 18904 Loop Cloth[4] | 17 |
| B6 | Safety-Walk ™ Type 370 Medium Resilient Treads[1] | 48 |
| B7 | BRUSHLON ® brush material, No. 331B 0.005" × 0.1875" Trim Type L 20⁻Tilt[1] | 56 |
| B8 | BRUSHLON ® brush material, No. 331B 0.003" × 0.125" Trim Type L 20⁻Tilt[1] | 64 |

Notes
[1]Available as identified from Minnesota Mining and Manufacturing Company, St. Paul, Minnesota.
[2]The back side (no stems) of the inventive pull roll cover material formed from impact copolymer resin available from Shell Polypropylene Company, Houston, Texas, under the designation SRD7-560.
[3]The front (surface stem) side of the inventive pull roll cover material formed from impact copolymer resin available from Shell Polypropylene Company, Houston, Texas, under the designation SRD7-560.
[4]Available as identified from Guilford Mills, Inc., Greensboro, North Carolina.

The majority of these items were secured to the core using hook-and-loop mechanical attachment structures. The pull roll cover test material was laminated to a hook structure backing, with the hooks projecting oppositely from the frictional engaging surface of the pull roll cover test material. A corresponding loop structure was secured about the core for engagement with the loop structure backing on the pull roll cover test materials. The hook structure in this example constituted either Velcro™ 811, Velcro™ 887 (both available from Velcro USA, Inc., Manchester, N.H.) or the polyolefin "mushroom" hook fastener portion of the 3M Mechanical Fastener Diaper Closure System (available from Minnesota Mining and Manufacturing Company, St. Paul, Minn.). The loop structure was Guilford 18904 loop cloth, available from Guilford Mills, Greensboro, N.C.

Since a pull roll cover is typically intended to prevent slippage of the fabric web and pull roll surface, a measurement of the static friction or the force required to create a slip between a fabric and a variety of pull roll cover test materials was performed. This analysis measured the horizontal force required to cause movement of a two-inch by four-inch surface of 14 oz. denim cloth against a pull roll cover material at two separate normal forces or weights on the two-inch by four-inch surface. The cloth was tested with its lighter colored (back) side facing the pull roll cover surface. The cloth was anchored to a metal block which was placed on top of a pull roll surface attached to a table top. The coefficient of friction was then calculated by dividing the horizontal force to cause slippage by the weight on the two-inch by four-inch surface area. The horizontal force was measured with a Chatillon force gauge Model DPP-50 (available from Chatillon, John & Sons, Inc., Greensboro, N.C.). The measured horizontal forces and resultant coefficients of friction (COF) are presented in Table III below at both normal forces. Theoretically, the coefficient of friction is independent of surface area of contact and the normal force applied (for friction considered on a microscopic scale—i.e., a "smooth" surface against a "smooth" surface). In the present case, the frictional effect must be considered on a macroscopic sale (i.e., including the effect of the penetration of the stems into the weave of the web), so the expected independence of COF on surface area and normal force may not hold true.

TABLE III

| Item | Pull Roll Cover Test Material | | Horizontal Force (lbs), at Normal Force = 8.344 lbs | COF | Horizontal Force (lbs), at Normal Force = 26.358 lbs | COF |
|---|---|---|---|---|---|---|
| C1 | Scotch ™ PTFE Glass Cloth Tape 5453 | 1 | 1.6 | 0.19 | 4.8 | 0.18 |
| C2 | Smooth Back of Stem Web (back side of Item C7) | 2 | 3.3 | 0.40 | 9.6 | 0.37 |
| C3 | Guilford 18904 Loop Cloth | 3 | 3.7 | 0.44 | 9.0 | 0.34 |
| C4 | 500 Impact Stripping Tape | 1 | 4.5 | 0.54 | 13.6 | 0.51 |
| C5 | Safety-Walk ™ Type 220 Fine Resilient Treads | 1 | 4.5 | 0.54 | 13.8 | 0.52 |
| C6 | Safety-Walk ™ Type 370 Medium Resilient Treads | 1 | 5.0 | 0.60 | 15.8 | 0.60 |
| C7 | Stem Side of Stem Web (Stem Height approx. 0.030", Stem Dia. 0.015", Stem Spacing 0.055", Stem Density 325 stems/in$^2$, Substrate Thickness 0.005") | 4 | 6.0 | 0.72 | 16.6 | 0.63 |
| C8 | Stem Side of Stem Web (Stem Height approx. 0.006", Stem Dia. approx. 0.006", Stem Spacing 0.032", Stem Density 960 stems/in$^2$, Substrate Thickness 0.004") | 4 | 6.1 | 0.74 | 18.6 | 0.71 |
| C9 | Scotch ™ Polyurethane Protective Tape 8671 | 1 | 7.1 | 0.85 | 18.3 | 0.70 |
| C10 | 216U Stikit ™ Grade P320 Rolls | 1 | 7.4 | 0.88 | 20.4 | 0.77 |
| C11 | 216U Stikit ™ Grade P400 Rolls | 1 | 7.7 | 0.92 | 20.0 | 0.76 |
| C12 | 216U Stikit ™ Grade P180 Rolls | 1 | 7.8 | 0.94 | 21.1 | 0.80 |
| C13 | 216U Stikit ™ Grade P100 Rolls | 1 | 9.5 | 1.14 | 28.1 | 1.07 |

Notes
1. Available as identified from Minnesota Mining and Manufacturing Company, St. Paul, Minnesota.
2. The back (no stems) side of the inventive pull roll cover material, formed from impact copolymer resin available from Shell Polypropylene Company, Houston, Texas, under the designation SRD7-560.
3. Available as identified from Guilford Mills, Inc., Greensboro, North Carolina.
4. The front (surface stem) side of the inventive pull roll cover material, formed from impact copolymer resin available from Shell Polypropylene Company, Houston, Texas, under the designation SRD7-560.

The inventive pull roll cover (such as Items C7 and C8 in Table III) exhibits a particular frictional performance, as recognized by the above testing. That performance can be varied, not only by varying certain design parameters of the pull roll cover (e.g., stem height, diameter, density or spacing) but also by varying the material itself. Alternative materials for forming the pull roll cover have been mentioned above, and the frictional properties of those materials can be further altered by the use of additives (e.g., a filler) or coatings (e.g., a lubricious coating).

The significance of the mechanical interengagement component of the frictional characteristics of the inventive pull roll cover is illustrated by the results of further static friction testing in the manner detailed above. The horizontal force required to cause movement of a two-inch by four-inch surface of 14 oz. denim cloth or steel against a pull roll cover material at a normal force of 8.344 lbs. on a surface was measured. The cloth was tested with its lighter colored (back) side facing the pull roll cover surface. The cloth was anchored to a metal block which was placed on top of a pull roll surface attached to a table top. Items D1, D2 and D3 were tested on separate occasions for the cloth, hence the additional test data. The coefficient of friction was then calculated by dividing the horizontal force to cause slippage by the weight on the two-inch by four-inch surface area. The horizontal force was measured with a Chatillon force gauge Model DPP-50 (available from Chatillon, John & Sons, Inc., Greensboro, N.C.). The measured horizontal force and calculated coefficients of friction (COF) are presented in Table IV below.

TABLE IV

| Item | Pull Roll Cover Test Material | Surface Material | Horizontal Force (lbs), at Normal Force = 8.344 lbs | COF |
|---|---|---|---|---|
| D1 | Smooth Back of Stem Web (back side of Item D2) | Steel | 1.77 | 0.2117 |
| | | Cloth - 1st | 3.33 | 0.3994 |
| | | Cloth - 2nd | 2.3 | 0.2756 |
| D2 | Stem Side of Stem Web (same parameters of Item A2 from Table I herein) | Steel | 1.8 | 0.2157 |
| | | Cloth - 1st | 6.03 | 0.7231 |
| | | Cloth - 2nd | 6.07 | 0.7275 |
| D3 | Stem Side of Stem Web (same parameters of Item A3 from Table I herein) | Steel | 1.9 | 0.2277 |
| | | Cloth - 1st | 6.13 | 0.7351 |
| | | Cloth - 2nd | 5.76 | 0.6903 |
| D4 | Stem Side of Stem Web (same parameters of Item A4 from Table I herein) | Steel | 1.9 | 0.2277 |
| | | Cloth | 6.03 | 0.7231 |

The pull roll cover test materials in Table IV are either the back side (Item D1—no stems) of the inventive pull roll cover material, or its front side (Items D2, D3 or D4—surface stems), and all were formed from an impact copolymer resin available from Shell Polypropylene Company, Houston, Tex., under the designation SRD7-560. The coefficient of friction for each of the different pull roll cover test materials in Table IV is much lower for the steel surface than the coefficients of friction for that same material in relationship to the cloth surfaces. The difference is believed to be the result of the mechanical interengagement of the surface stems and weave of the cloth, and its contribution to the frictional interrelationship between those two materials. As can be seen by a comparison of the steel coefficients of friction and the cloth coefficients of friction in Table IV, this contribution is significant.

The present invention further relates to an apparatus and method for use of a readily replaceable (or repositionable), low profile pull roll cover. The invention allows relatively quick changeover from one cover to another on a pull roll by a simple and efficient arrangement that results in low machine downtime. In addition, the present invention does not require special handling or expertise (e.g., hazardous waste disposal) in the pull roll cover replacement process, and it provides for an extremely low profile pull roll cover attachment. The present invention simplifies the cover application and replacement process, since it does not necessarily require the application of a fastener material onto the pull roll prior to application of the pull roll cover itself.

Previously, opposed hook-and-loop fastener structures have been used to replaceably secure pull roll covers to pull rolls. A hook structure material was mounted onto the pull roll, and the pull roll cover (with loop structure material on its back side) was then spirally wrapped about and affixed to the hook structure material on the pull roll. This two-part fastening scheme requires additional material in forming a pull roll cover, both in terms of hook structure material provided and aligned on the pull roll itself, and loop structure material aligned and secured on the back side of the desired pull roll cover material. This two-part fastening scheme also necessarily adds depth to the pull roll cover, since the hook-and-loop fastener structures require some intermingling space therebetween for engagement purposes. This depth must be added to the effective radius of the pull roll cover as the exterior thereof engages the advancing textile web. As mentioned, alterations to the diameter of a pull roll by means of a pull roll cover (or its attachment scheme), may require likewise alterations in the rate of pull roll rotation or in the handling of the textile web to accommodate the diametric change. In using the hook-and-loop fasteners of the prior art, it also occurred that occasionally one or more hooks protruded (because of an imperfect helical wrap of the pull roll cover) from the pull roll exterior to contact the fabric web in use, picking and tearing at the fabric web as it traversed the pull roll cover. Any change to the surface of the cloth or its weave produced by contact with the pull roll is considered to be damage to the cloth and is thus to be avoided.

The pull roll cover attachment of the present invention involves securing the pull roll cover directly onto the pull roll by means of a repositionable pressure sensitive adhesive (PSA). A repositionable pressure sensitive adhesive is a low tack adhesive, having sufficient adhesive qualities to maintain an article in place once applied to a surface, but allowing the adhesive to be overcome if it is desired to reposition or remove the article. The repositionable adhesive leaves no appreciable residue once removed, and retains sufficient tack to be re-adhered once repositioned on a mounting surface. Repositionable pressure sensitive adhesives are further described in U.S. Pat. Nos. 3,691,140 and 4,166,152, both of which are incorporated by reference herein. This attachment arrangement for a pull roll cover does not appreciably add to the radius of the pull roll cover, thus creating a very low profile pull roll cover assembly. Further, there are no components of this pull roll cover attachment which pick or tear at the textile web as it traverses the pull roll cover, and no undesirable residue is left on the pull roll when covers are changed.

Figure 4:
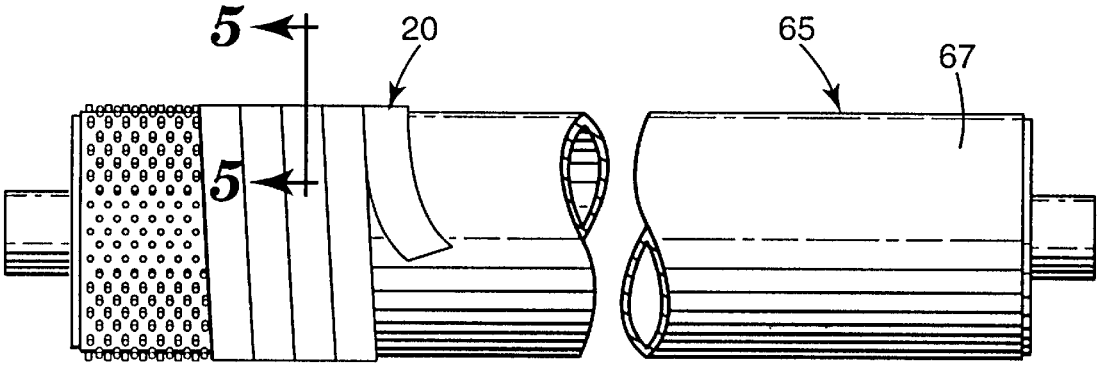
FIG. 4 is a schematic view of a strip of pull roll exterior cover material partially wound about the cylindrical base of a pull roll.

FIG. 4 illustrates the preferred method for the application of a strip of pull roll cover 20 about the cylindrical outer surface of a pull roll 65. The pull roll cover 20 is preferably applied in a narrow strip (e.g., one to four inches wide) wrapped helically about a cylindrical outer surface 67 of the pull roll 65. The entire cylindrical outer surface 67 of the pull roll 65 (or at least that portion of the pull roll that contacts the textile web) is covered in this manner with the pull roll cover 20. While a helical application is shown, other alignments are also possible.

Figure 5:
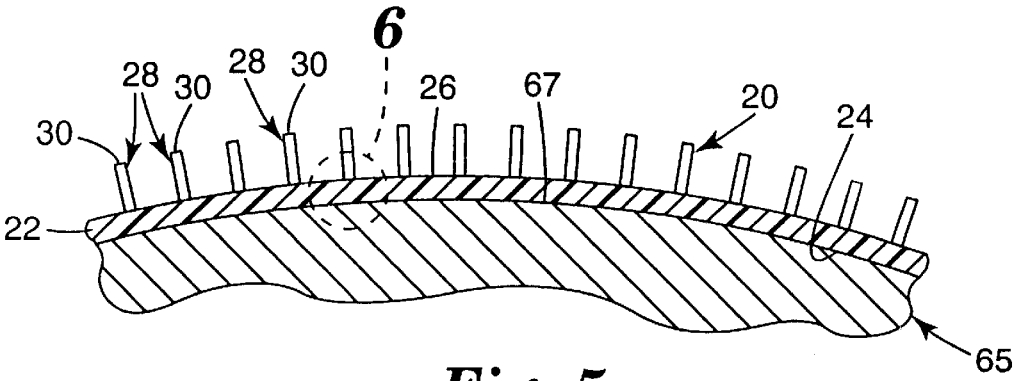
FIG. 5 is a sectional view as taken along lines 5—5 in FIG. 4.

FIG. 5 illustrates, in more detail, the nature of the pull roll cover 20 and its mounting to the pull roll 65. When mounted as shown, the surface stems 28 of the pull roll cover 20 project outwardly from the second side 26 of the substrate 22. The surface stems 28 thus define the cylindrical operative textile contact surface of the pull roll 65.

Figure 6:
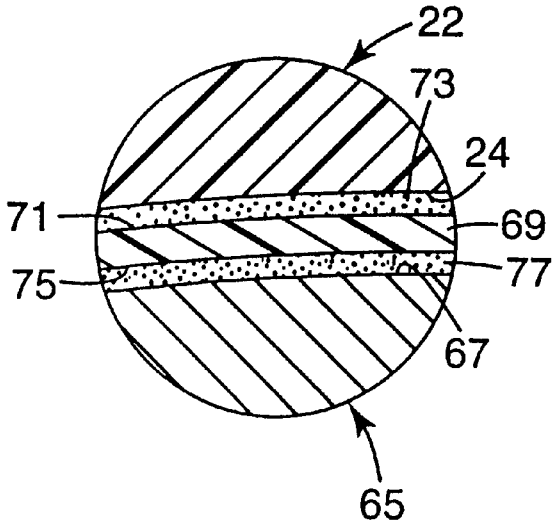
FIG. 6 is an enlarged sectional view of a portion of FIG. 5.

On its opposite side (first side 24), the substrate 22 of the pull roll cover 20 is bonded to the cylindrical outer surface 67 of the pull roll 65. This bond is preferably achieved by a laminating adhesive assembly, as more specifically illustrated in FIG. 6 (as mentioned above, the drawing figures are not to scale, portions being enlarged for clarity). A sheet or scrim 69 has its first side 71 bonded by a nonrepositionable pressure sensitive adhesive layer 73 to the first side 24 of the substrate 22. The particular nonrepositionable adhesive selected depends upon the characteristics of the compositions used to form the substrate 22 of the pull roll cover. In any event, the lamination of sheet 69 to substrate 22 is intended to be permanent.

On its second side 75, the sheet 69 is bonded to the cylindrical outer surface 67 of the pull roll 65 by a low tack pressure sensitive adhesive layer 77. This lamination is intended to be repositionable in nature, so that the pull roll cover 20 may be repositioned (or removed) relative to the pull roll 65 by release of the low tack repositionable pressure sensitive adhesive from the cylindrical outer surface 67.

In a preferred embodiment, these low tack adhesive properties are provided by Scotchmark™ 9870 High-Low Tack Laminating Adhesive, available from Minnesota Mining and Manufacturing Company, St. Paul, Minn. The Scotchmark™ 9870 laminating adhesive has a polyester scrim or carrier (sheet 69). This prevents any bleed through of nonrepositionable adhesive toward the cylindrical outer surface 67 of the pull roll 65, and thus lessens the likelihood of any nonrepositionable adhesive residue being left on the surface 67. Webs of the pull roll cover and laminating adhesive are laminated by feeding those webs from rolls, removing and winding up any necessary adhesive liners, and bringing the layer 73 of nonrepositionable adhesive together against the second side 24 of the pull roll cover substrate 22 in a rolling nip under controlled tension and pressure. The joined materials are then slit with a rolling knife and wound on cores to produce strip rolls of the pull roll cover. The width of each pull roll cover assembly strip roll ranges from one to four inches, and preferably from two to three inches. A liner remains over the layer 77 of low tack pressure sensitive adhesive, to be removed upon application of the pull roll cover to the cylindrical outer surface 67 of a pull roll 65.

As mentioned above, in a preferred embodiment, the pull roll cover used with a particular pull roll should not be so thick as to significantly modify the effective diameter of the pull roll. The thickness of the Scotchmate™ 9870 laminating adhesive is approximately 2.5 mil, and thus provides an attachment means for the exterior pull roll cover which adds no appreciable increase to the pull roll diameter. Any change in diameter between pull roll covers on a single pull roll thus depends on the thickness of the pull roll covers themselves, and not on their repositionable pressure sensitive adhesive attachment means. The pull roll cover, such as described above and illustrated in FIG. 5, preferably has a thickness of less than 0.500 inches, more preferably less than 0.250 inches, and most preferably less than 0.050 inches, thus defining an extremely low profile covering for the pull roll.

Other suitable pressure sensitive adhesive arrangements are contemplated. For instance, a nonrepositionable pressure sensitive adhesive can be laminated on the second side 24 of the substrate 22, with a low tack pressure sensitive adhesive laminated over the high tack adhesive. Suitable pressure sensitive adhesives for this purpose are Scotch™ 919 Laminating Adhesive and Scotch™ 9449 Laminating Adhesive, respectively, both available from Minnesota Mining and Manufacturing Company, St. Paul, Minn. Again, this adhesive arrangement is extremely thin, preferably accumulating to less than 0.050 mil. For this specific arrangement, over time (e.g., 30 days), the nonrepositionable adhesive will bleed through to the low tack adhesive, and the repositionable characteristics of the low tack adhesive will deteriorate.

The embodiment illustrated in FIG. 5 uses both the low profile pull roll cover 20 having upstanding surface stems 28, and the disclosed very low profile pull roll cover attachment means. When a change in pull roll covers is desired, the pull roll cover 20 is simply peeled away from the cylindrical outer surface 67 of the pull roll 65 to separate the repositionable (low tack) pressure sensitive adhesive layer 77 from the cylindrical outer surface 67 of the pull roll 65. A replacement pull roll cover, having one side defined by a replacement textile engaging material and the other side bearing repositionable pressure sensitive adhesive, is then applied to the pull roll 65 by wrapping it about the pull roll 65 and pressing it thereto. The replacement pull roll cover is also typically applied as a thin strip, helically wrapped about the pull roll as illustrated in FIG. 4. Replacement can be performed simply to replace a worn pull roll cover with another having the same frictional and mechanical engagement properties, or to replace a pull roll cover with another pull roll cover having different desired frictional and mechanical engagement properties. For instance, with respect to the inventive pull roll cover 20 illustrated in FIGS. 2A, 2B and 5, different desired frictional and mechanical engagement characteristics may be achieved by substituting a different pull roll cover of the same general structure, but having different surface stem densities, spacings, heights or diameters, or being formed from a different (i.e., less lubricious) material. There is no appreciable adhesive residue buildup from one cover to the next on a pull roll, so that the initial diameter of that pull roll is maintained over time and various pull roll cover applications.

Figure 7:
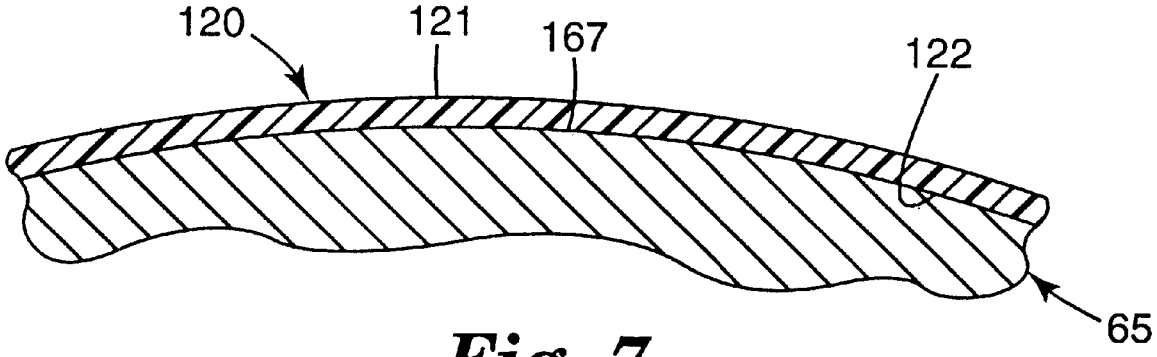
FIG. 7 is a sectional view of an alternate pull roll cover of the present invention.

The use of the inventive repositionable pressure sensitive adhesive pull roll fastening arrangement of the present invention thus provides for a wide range of pull roll cover options for the same pull roll. The different pull roll cover materials can be readily replaced (or repositioned if initially misaligned during application) because of the ease and effectiveness of the inventive attachment arrangement. This is illustrated, for example, by FIG. 7, wherein a pull roll cover 120 is formed from an alternative material or structure. The cover 120 could include any of the types of pull roll cover materials mentioned herein, such as cork, rubber, sandpaper, bristle brushes, films, cloths, Teflon™ substrates, polymeric coatings, polymeric coatings containing additives, coated abrasives, nonwoven abrasives, polymeric films, glass coatings, paper, foam, nonwoven materials, metal foils, texturized polymers and other materials, such as those listed in Tables II and III. Another pull roll cover material is a microreplicated surface, such as a structured abrasive article, available under the trade designation 207EA structured abrasive article, available from Minnesota Mining and Manufacturing Company, St. Paul, Minn. The possible materials are limited only by the desired frictional characteristics of such materials, and their suitability for use in a particular textile pull roll application. The alternative pull roll cover 120 has an exterior textile engaging surface 121 on one side, and on its opposite side 122, it bears a layer of repositionable pressure sensitive adhesive which is brought into adhering contact with the cylindrical outer surface 167 of pull roll 165. The pull roll cover 120 can thus be easily and efficiently removed for replacement with another pull roll cover having the same or different frictional and mechanical engagement characteristics, as desired.

The pull roll cover of the present invention overcomes many of the disadvantages of the prior art. It provides a pull roll cover having initially uniform and extremely consistent frictional engagement characteristics, as well as the possibility for controlled and non-abrasive mechanical engagement with a textile web traversed thereby. The inventive pull roll cover has a low profile and maintains its engagement properties uniformly during wear of its surface stems. The pull roll cover surface stems do not pick or tear the textile web, it is resistant to the transference of dye from one textile web lot to another, and it does not exhibit a buildup of lint and fibers during use. The pull roll cover, when combined with the inventive repositionable pressure sensitive adhesive for attaching a pull roll cover to a pull roll, results in a superior, extremely low profile, inexpensive and easy to use pull roll cover replacement arrangement. The unique and inventive attachment arrangement eliminates the possibility of damage or picking of the textile web by the pull roll cover attachment arrangement.

Although the present invention has been described with reference to preferred embodiments, workers skilled in the art will recognize that changes may be made in form and detail without departing from the spirit and scope of the invention. For example, the orientation of the laminating adhesives may be reversed such that the nonrepositionable adhesive faces the pull roll surface and the repositionable adhesive is exposed on the pull roll (so that the repostionable adhesive is on the pull roll rather than the on the replaceable cover). Alternatively, a discrete sheet having repositionable pressure sensitive adhesive on both its sides may be disposed between the roll and roll cover. In addition, the base for application of invention has only been described with respect to cylindrical pull rolls. The inventive cover and the novel cover attachment method disclosed herein can be applied to other base structures, such as an endless belt or other surface which may come into contact with an advancing textile web in a textile processing or manufacturing facility. Further, the invention is also applicable in applications other than textile pull rolls. Any surface which contacts a web or sheet or other substrate workpiece is a candidate for the inventive cover and inventive cover attachment arrangement of the present invention. For instance, the roll cover can be applied to a one-inch diameter transfer roll in a photocopy machine. In this regard, possible web materials may include, but are not limited to, woven, nonwoven, knitted, needle tacked, wet laid, stitch bonded and spun bonded materials, as well as papers, films, foils and metal sheets or strips.

What is claimed is:

1. An engagement apparatus for engaging an advancing web having surface interstices thereon, the engagement apparatus comprising:

a surface substrate sheet having first and second sides, the second side having a plurality of identical surface stems projecting outwardly therefrom, the surface stems being disposed in a selected arrangement on and formed integrally with the surface substrate sheet, each surface stem having a constant diameter along its entire height, and outer ends of the surface stems collectively defining an operative contact surface for engaging an advancing web and sized to penetrate the surface interstices of the advancing web when traversed thereby; and a repositionable pressure sensitive adhesive disposed on the first side of the surface substrate sheet to allow releasable adherence of the surface substrate sheet to a support surface, the repositionable pressure sensitive adhesive being a low tack adhesive that retains sufficient tack to be re-adhered once repositioned on the support surface and that leaves no appreciable residue once removed therefrom.

2. The engagement apparatus of claim 1 wherein the selected arrangement is a uniform array.

3. The engagement apparatus of claim 1 wherein the surface stems are selected from the group consisting of thermoplastic polyurethanes, polyvinyl chlorides, polyamides, polyimides, polyolefins, polyesters, polystyrenes, nylons, acetals, block polymers, polycarbonates, thermoplastic elastomers, and copolymers and combinations thereof.

4. An engagement apparatus for engaging an advancing web having surface interstices thereon, the engagement apparatus comprising:

a surface substrate sheet having first and second sides, the second side having desired characteristics for frictional engagement with the advancing web; and a repositionable pressure sensitive adhesive disposed on the first side of the surface substrate sheet to allow releasable adherence of the surface substrate sheet to a support surface, the repositionable pressure sensitive adhesive being a low tack adhesive that retains sufficient tack to be re-adhered once repositioned on the support surface and that leaves no appreciable residue once removed therefrom.

5. The engagement apparatus of claim 1 wherein the substrate sheet is resistive to color transfer from the advancing web in engagement therewith.

6. The engagement apparatus of claim 1 wherein the surface substrate sheet is helically wrapped around the cylindrical outer surface of the pull roll.

7. The engagement apparatus of claim 1 wherein the repositionable pressure sensitive adhesive is carried on the first side of the surface substrate sheet.

8. A pull roll assembly for traversing an advancing web, the pull roll assembly comprising:

a pull roll having an axis and a cylindrical outer surface;

a pull roll cover helically wrapped about at least that portion of the cylindrical outer surface of the pull roll that engages an advancing web, the pull roll cover being defined by a substrate sheet having first and second sides, the second side being defined by the outer ends of a plurality of cylindrically shaped stems projecting radially outwardly relative to the pull roll axis, the stems being disposed in a uniform array on and formed integrally with the substrate sheet, and the stems being generally uniform in shape and height and each stem having a constant cross-sectional diameter along its entire height; and a repositionable pressure sensitive adhesive carried on the first side of the substrate sheet of the pull roll cover to releasably adhere the pull roll cover to the cylindrical outer surface of the pull roll for replacement or realignment, the repositionable pressure-sensitive adhesive being a low tack adhesive that retains sufficient tack to be re-adhered once repositioned on the cylindrical outer surface of the pull roll and that leaves no appreciable residue once removed therefrom.

9. The pull roll assembly of claim 8 wherein the substrate sheet is resistive to color transfer from the advancing web in engagement therewith.

10. The pull roll assembly of claim 8 wherein the surface stems are selected from the group consisting of thermoplastic polyurethanes, polyvinyl chlorides, polyamides, polyimides, polyolefins, polyesters, polystyrenes, nylons, acetals, block polymers, polycarbonates, thermoplastic elastomers, and copolymers and combinations thereof.

11. A pull roll assembly for traversing a linearly advancing web, the pull roll assembly comprising:

a pull roll having an axis and a cylindrical outer surface;

a pull roll cover helically wrapped about at least that portion of the cylindrical outer surface of the pull roll that engages an advancing web, the pull roll cover being defined by a substrate sheet having first and second sides, the second side having desired characteristics for frictional engagement with the advancing web; and a repositionable pressure sensitive adhesive on the first side of the substrate sheet of the pull roll cover to releasably adhere the pull roll cover to the cylindrical outer surface of the pull roll for replacement or realignment, the repositionable pressure-sensitive adhesive being a low tack adhesive that retains sufficient tack to be re-adhered once repositioned on the cylindrical outer surface of the pull roll and that leaves no appreciable residue once removed therefrom.

12. The pull roll assembly of claim 11 wherein the second side of the surface substrate sheet includes an exterior layer selected from the group consisting of teflon substrates, polymeric coatings, polymeric coatings containing additives, coated abrasives, nonwoven abrasives, bristles, brushes, smooth or textured polymeric films, glass coatings, cloth, rubber, paper, foam, nonwoven materials, and metal foils.

13. The pull roll assembly of claim 11 wherein the second side of the substrate sheet of the pull roll cover has a plurality of surface stems projecting radially outwardly relative to the pull roll axis, and the surface stems are disposed in a selected arrangement on and formed integrally with the substrate sheet.

14. The pull roll assembly of claim 13 wherein each of the surface stems is uniform in shape along its height.

15. The engagement apparatus of claim 1 wherein the advancing web is a woven textile web and wherein the outer ends of the surface stems engage the textile web in part by partial penetration thereof.

16. A pull roll assembly for traversing an advancing woven textile web having a weave defined by crossed fibers, the pull roll assembly comprising:

a pull roll having an axis of rotation and a cylindrical outer surface;

a pull roll cover defined by a longitudinal strip of cover material that is helically wrapped, edge to edge, about at least that portion of the cylindrical outer surface which is presented for engagement with the advancing woven textile web, the pull roll cover being defined by a substrate sheet having first and second sides, the second side being defined by the outer ends of a plurality of cylindrically shaped stems projecfing radially outwardly relative to the pull roll axis, the stems being disposed in a uniform array on and formed integrally with the substrate sheet, the stems being identical in shape and height and each stem having a constant cross-sectional diameter along its entire height which is sized so that the outer ends of the stems engage the weave of the advancing textile web by penetrating the interstices between crossed fibers thereof, whereby the constant diameters of the identically shaped stems present a uniform and unchanging engagement surface to the woven textile web as the stems wear down over time; and a repositionable pressure-sensitive adhesive carried on the first side of the substrate sheet of the cover material to releasably adhere the cover material to the cylindrical outer surface of the pull roll for replacement or realignment, the repositionable pressure sensitive adhesive being a low tack adhesive that retains sufficient tack to be re-adhered once positioned on the cylindrical outer surface of the pull roll and leaves no appreciable residue once removed therefrom.

17. The engagement apparatus of claim 4 wherein the second side of the surface substrate sheet includes an exterior layer selected from the group consisting of teflon substrates, polymeric coatings, polymeric coatings containing additives, coated abrasives, nonwoven abrasives, bristles, stems, brushes, smooth or textured polymeric films, glass coatings, cloth, rubber, paper, foam, nonwoven materials, and metal foils.

18. The engagement apparatus of claim 1 wherein the surface substrate sheet and repositionable pressure sensitive adhesive thereon have a thickness of less than 0.050 inches.

19. The engagement apparatus of claim 1 wherein the surface substrate sheet includes at least one layer of material adapted to prevent bleed through of adhesive.

* * * * *